US007217201B2

(12) United States Patent
Sealy

(10) Patent No.: US 7,217,201 B2
(45) Date of Patent: May 15, 2007

(54) SPORTS TRAINING APPARATUS AND METHOD OF USE

(76) Inventor: Michael W. Sealy, 2721 Second St., #109, Santa Monica, CA (US) 90405

( * ) Notice: Subject to any disclaimer, the term of this patent is extended or adjusted under 35 U.S.C. 154(b) by 45 days.

(21) Appl. No.: 10/855,472

(22) Filed: May 26, 2004

(65) Prior Publication Data

US 2005/0266938 A1 Dec. 1, 2005

(51) Int. Cl.
*A63B 69/00* (2006.01)

(52) U.S. Cl. ..... 473/422; 482/74

(58) Field of Classification Search ..... 224/257, 224/259; 473/464, 459, 416, 422, 458; 482/105, 482/106, 74; D3/225; 2/22, 414, 456, 462, 2/464; 128/870; 602/1–20
See application file for complete search history.

(56) References Cited

U.S. PATENT DOCUMENTS 2,853,111 A * 9/1958 Williams ..... 224/259
3,152,738 A * 10/1964 Worsfold, Jr. ..... 224/259
5,016,797 A * 5/1991 Rowledge ..... 224/257
5,556,090 A * 9/1996 Coleman ..... 473/468
5,658,203 A * 8/1997 Shub ..... 473/205
5,933,874 A * 8/1999 Randolph ..... 2/463
6,648,191 B2 * 11/2003 Giggleman ..... 224/260
2002/0121742 A1 * 9/2002 Stauber ..... 273/458

OTHER PUBLICATIONS

Web Page Download, CoolPoolDeal, 1988, www.coolpooldeals.com, 3 pages.*
Webpage download, MarkBerman, Feb. 29, 2004, www.bermanbasics.com/berman/product289.html, 1 page.*

* cited by examiner

*Primary Examiner*—Eugene Kim
*Assistant Examiner*—M. Chambers
(74) *Attorney, Agent, or Firm*—Venable LLP; JoAnne M. Esty; Stefan J. Kirchanski

(57) ABSTRACT

A sports training apparatus having a substantially resilient elongated arm support coupled to straps adapted to surround an athlete's shoulders to hold the arm support securely against the athlete's chest and under the athlete's arms to facilitate the proper training position for a variety of sports activities. Methods of using the training apparatus are also disclosed.

18 Claims, 7 Drawing Sheets

SPORTS TRAINING APPARATUS AND METHOD OF USE

CROSS-REFERENCE TO RELATED APPLICATIONS

Not Applicable

STATEMENT REGARDING FED. SPONSORED R & D

Not applicable.

REFERENCE TO SEQUENCE LISTING

Not applicable.

BACKGROUND OF THE INVENTION

This invention relates generally to methods and apparatus for sports training, and more particularly to methods and devices that prevent a user's arms from moving too close to the body during certain athletic activities.

Many poor habits in sports develop during training when athletes engage in excess arm movements, and specifically when they allow their elbows to come too close to their bodies. An athlete's range of motion is greatly decreased as his or her arms move closer to the body. Such restriction interferes with proper passing, digging and blocking form for volleyball, proper shot mechanics for basketball, and proper fielding in baseball and softball. Moreover, catching fundamentals in many sports are enhanced if the athlete is able to keep his or her elbows an appropriate distance away from the body while performing these actions. If the athlete instead performs these actions in the frontal plane with elbows away from the body, this form will give the athlete more range and a faster response time to react to various situations in the game.

A number of sports training devices have been reported that address arm positioning. For instance, Cook, U.S. Pat. No. 6,283,877 (the "Cook Patent") discloses a device that uses a restricting line, designated as an "assembly line" connected to a wristband and a waist band on the athlete to limit forward movement of a basketball shooter's non-shooting hand. The stated purpose of the device is to teach the athlete to shoot a basketball with one hand. The restricting line works to help keep the athlete's non-shooting elbow close to the body, forcing the athlete to finish the shot with the other "shooting" hand. (Cook Patent, Col. 1, Lines 26–27.) However the device does not help train the athlete for those basketball techniques that require a greater range of motion, which is enhanced if the athlete keeps the arms away from the body. For instance, in a jump shot, the shot release is quicker and more efficient if the athlete keeps his or her elbows away from the body, thus decreasing the chances of having the shot blocked. The device of the Cook Patent is not suitable for developing this type of form, because is designed to develop proper form for movements that require the elbow to be kept close to the body.

Sheppard, U.S. Pat. No. 6,645,093 (the "Shepard Patent") describes a device to control the movement of a basketball shooter's shooting arm in a predetermined direction with predetermined elbow placement. The device includes an rigid arm bar strapped to the shooting arm and pivotally connected to a back plate strapped to the athlete's back. A stated purpose of the device is to assure that "the athlete's arm cannot move inwardly or outwardly from the desired plane." (Shepard Patent, Col. 6, Lines 41–46.) The athlete's arm is restricted to movement in an arc from his or her side in a "vertical plane" extending outwardly and forwardly from the front of the athlete's arm. However, the device is not intended to help athletes achieve the proper from for such basketball techniques described above where the technique is enhanced by the athlete's ability to maintain his elbow away from his torso. Moreover, the device essentially "locks" the athlete's arm into a motion in the arc of a single plane, thereby limiting the usefulness of the device in general training exercises where the athlete may need to perform activities where the arm restriction proves detrimental. For instance, an athlete wearing such a device during training would find it particularly difficult to catch a basketball prior to performing the required shot.

Caveness, U.S. Pat. No. 3,820,783 (the "Caveness Patent") discloses a device having a belt-supported arm that extends upwardly and forwardly from the athlete's abdomen with a transverse gauge bar at its upper end to indicate the height at which a basketball shooter's elbow should be before extending the arm to shoot a basket. While the device serves as a gauge for proper elbow height for shooting, it does not prevent the elbow from moving too close to the torso. Moreover, the device is bulky, with rigid components, some at face height, which precludes its use in general training where unexpected contact with the device could cause injury.

Selberg, U.S. Publication No. 2003/0190984 (the "Selberg Application") discloses a volleyball training device that includes a restricting lines or "cords" connected by straps to an athlete's thighs and elbows limiting the distance that the elbows can move away from the thighs and from one another. The stated purpose of the device is to retain the elbows within a predetermined distance apart so that they are locked and close to one another. However the device does not help train the athlete for those volleyball techniques that require a greater range of motion, which is enhanced if the athlete keeps the arms away from the body. For instance, certain passing, digging and blocking shots are enhanced if the athlete keeps his or her elbows away from the body. Moreover, since the device essentially ties the athlete's arms to his legs, maintaining him in a squat position, the device is not suitable for general training requiring a wide variety of movements.

Szabo, U.S. Pat. No. 4,795,163 (the "Szabo Patent") describes a volleyball training device that includes a rigid rod attached to an athlete's bicep and having a ball at the distal end of the rod, which the athlete grabs. The device essentially locks the athlete's arm into place. The stated purpose of the device is to teach proper form for the forearm bump pass, and particularly to prevent the elbows from bending. Since the device does not attach to the shoulders, it does not control lateral or forward arm movement and thus does not assist in the development of techniques that require such arm placement. Moreover, since the device rigidly locks the athlete's arms, it is not suitable for general training where a volleyball player would need more arm flexibility, for instance to protect himself if a ball approaches his face.

While the above disclosed devices help develop specific athletic techniques, none address the common problem of correcting the athlete's tendency to allow her arms and elbows to move too close to her torso rather than positioning them away from and in front of her body in the frontal plane. Such positioning is necessary for faster performance of many athletic techniques as described above. Moreover, the devices are specific to the sports of either volleyball or basketball and do not address form problems in other sports.

For instance, softball and baseball fielders also achieve a greater range of motion by maintaining their elbows away from their body in the frontal plane. A receiver in football is taught to catch the ball by reaching for the ball and not letting it come into his chest to create more efficient moves and decrease the time that a defender has to defend the pass. Also, the devices described must be used in very controlled training environments, because they lock body parts and some have rigid members that can cause injury to the user or other in the game.

A need exists for a lightweight athletic training device that helps an athlete keep his or her arms away from the body while not restricting other bodily movements that can be used in general training settings without a risk of injury to the athlete or others she may come into contact with. Existing devices are inadequate for this purpose.

BRIEF SUMMARY OF THE INVENTION

The present invention relates to sports training apparatus and methods of use, and particularly to apparatus that can be used in general training settings where an athlete's performance is enhanced by keeping his or her arms and elbows away from the body. The apparatus includes an elongated arm support that is securely held against an athlete's chest and under his or her arms by straps that encircle the athlete's shoulders. The arm support is made of a substantially resilient material to allow its use in a variety of training exercises while reducing the risk of injury to the athlete or to others active in the training session.

In one embodiment, the straps are permanently coupled to the arm support and sized during manufacturing to fit the athlete. In a preferred embodiment, the straps are removably coupled to the arm support to allow the apparatus to be adjusted to fit athletes of different sizes. Moreover, the removable adjustment permits the arm support to be positioned at various locations on the athlete's chest, facilitating positions with varying angles of the arm to the torso.

In one embodiment, the apparatus includes a lightweight bag that surrounds the elongated arm support to allow arm supports of a variety of configurations to be used. In another embodiment, the apparatus includes an elastic connector that surrounds the straps at the athlete's back and connects to itself. Use of such a connector provides additional support for apparatus positioning during training.

The methods of the present invention include positioning the elongated arm support of the sports training apparatus described above against the athlete's chest in a first position that supports the athlete's arms in the frontal plane at a first angle away from the torso that is proper for executing a first athletic technique. This athletic technique could be fielding a baseball, receiving a football, or the like. The straps are then brought under the athlete's arms and around the shoulders and removably coupled to the arm support to hold it in the first position. The athlete is then trained in the first technique, which can include the activity of other players in simulated play.

In another embodiment of the methods of the present invention, the ends of the straps are next removed from the arm support. The arm support is repositioned to a second position that supports the athlete's arms in the frontal plane at a second angle away from the torso that is proper for executing a second athletic technique. The straps are adjusted and recoupled to the arm support to snugly hold it in the second position. The athlete is then trained in the second technique. In another embodiment of the methods of use, a connector is placed around the straps at the athlete's back and coupled to itself to provide further support.

It is an objective of the apparatus and methods of the present invention to overcome the limitations of single-sport use of those devices described in the background section. It is a further objective of the apparatus and methods of the present invention to provide a reasonably safe training device that can be used in simulated play to train an athlete on a specific technique without unnecessarily restricting his or her ability to engage in the ancillary movements required for general training. Moreover, it is an objective of the invention to provide a low-cost, portable training apparatus that can be sized to fit a variety of athletic body sizes.

BRIEF DESCRIPTION OF THE SEVERAL VIEWS OF THE DRAWING

Reference is now made to a brief description of the drawings, which are intended to illustrate the sports training apparatus and methods of use herein. The drawings and detailed description which follow are intended to be merely illustrative and are not intended to limit the scope of the invention as set forth in the appended claims.

DETAILED DESCRIPTION OF THE INVENTION

Figure 1:
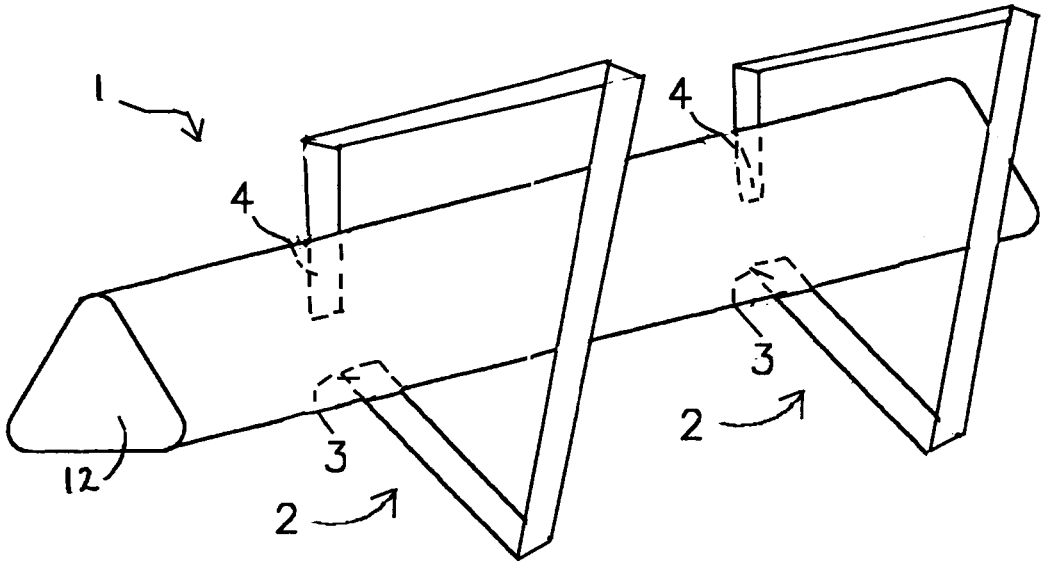
FIG. 1 depicts an oblique view of an embodiment of a sports training apparatus.

FIG. 1 depicts an embodiment of a sports training apparatus 1 for correcting the athlete's tendency to allow his arms and elbows to move too close to his torso during general training sessions while not restricting other bodily movements necessary for effective training. In this embodiment, a first end 3 and a second end 4 of a plurality of straps 2 are each coupled to an elongated arm support 12 to form a plurality of strap loops. The elongated arm support 12 is made of a substantially resilient material. In a preferred embodiment, the arm support is made of firm foam rubber, although other materials that will similarly deform upon substantial pressure and subsequently regain their original shape may also be used, for example other rubber materials that are non-foam, or composites of foam rubber of various degrees of resilience. In the embodiment of FIG. 1, the elongated arm support is wedge-shaped or triangular on cross-section, however other embodiments may have a different shape on cross-section such as square, rectangular, oblong, circular or other shapes.

Figure 6A:
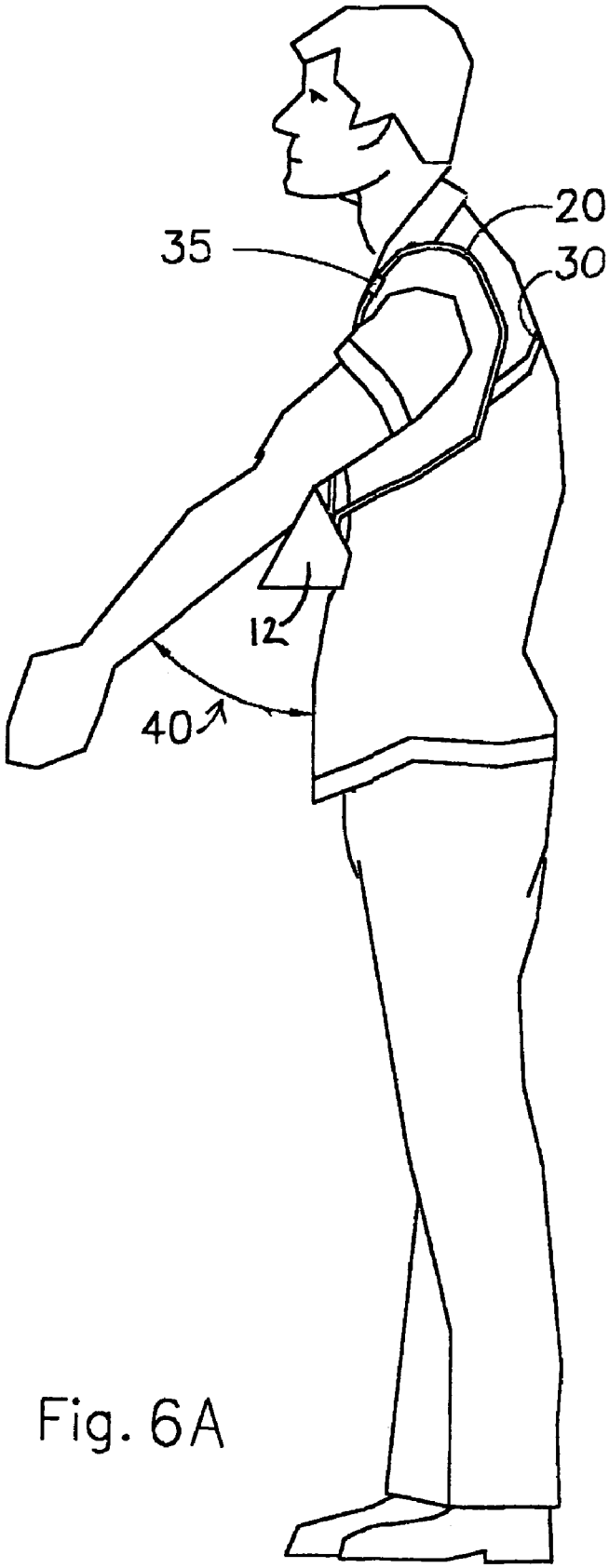
FIG. 6A depicts a lateral view of an athlete wearing an embodiment of a sports training apparatus.

In certain embodiments, the straps 2 are made of nylon, however other flexible, sturdy material such as rope, canvas or other materials may be used. In the embodiment of FIG. 1, the strap ends 3, 4 are permanently coupled to the elongated arm support using adhesive, stitching, mechanical couplers or other permanent coupling methods common in the sports apparatus industry. During assembly of the apparatus, the circumference of each strap loop is sized to encircle the athlete's shoulders to securely hold the elongated arm support 12 against the athlete's chest and under the athlete's arms to position the arms in front of and away from the chest, as best viewed in FIG. 6A, showing an alternate embodiment demonstrating the same principle. In a preferred embodiment, the straps 2 are made of a substantially elastic material that can stretch to fit a variety of shoulder sizes.

Figure 2:
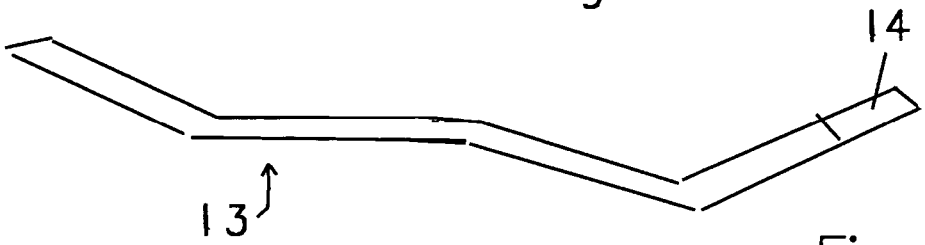
FIG. 2 depicts an embodiment of a strap of a sports training apparatus.
Figure 3:
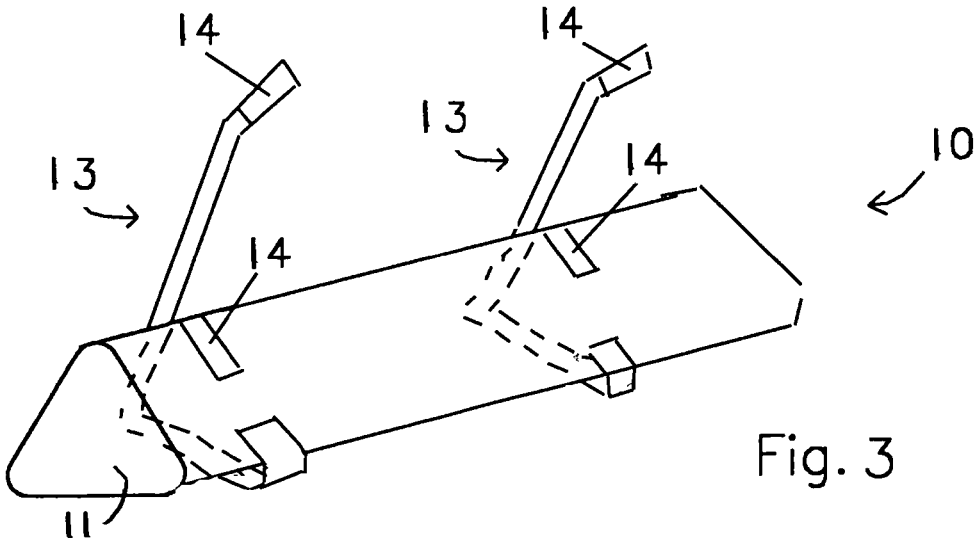
FIG. 3 depicts an oblique view of another embodiment of a sports training apparatus having the strap of FIG. 2.

FIG. 3 shows another embodiment of the sports training apparatus 10 having adjustable straps 13. As best seen in FIG. 2, the adjustable straps 13 further comprise a removable coupling device 14 on the second end of the strap. Returning to FIG. 3, the elongated arm support 11 also includes a removable coupling device 14. In a preferred embodiment, the removable coupling device is a hook and loop fastener such as VELCRO TM, although other removable coupling or fastening devices such as snaps may be used. In the embodiment of FIG. 3, the first end of the adjustable strap 13 is permanently coupled to the elongated arm support 11 and the fastening device 14 on the second end can be removably coupled to the fastening device 14 on the elongated arm support 11.

Figure 6B:
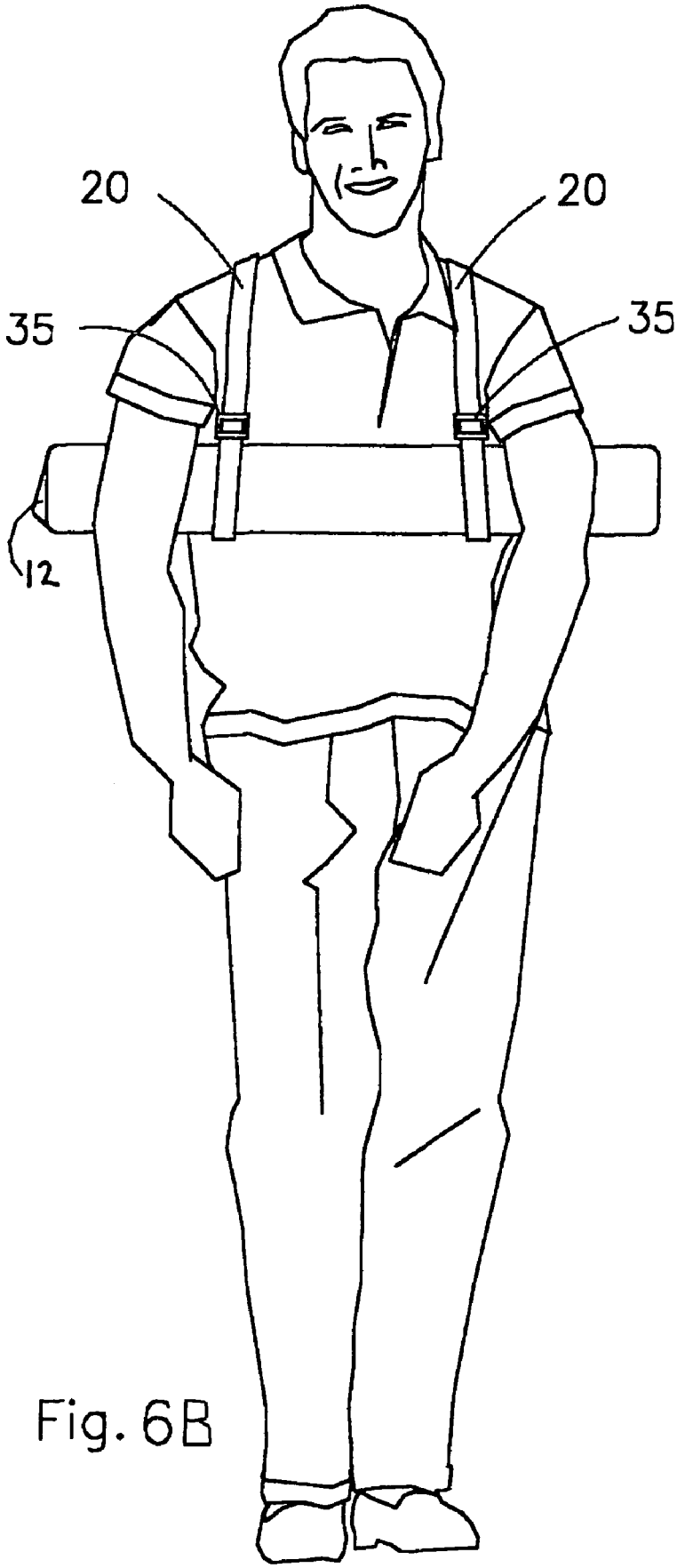
FIG. 6B depicts a front view of the subject of FIG. 6A.

In a preferred embodiment, the sports apparatus shown in FIGS. 1 and 3 has an elongated arm support having a longitudinal axis of a first length that is longer than a second length equal to the athlete's shoulder width, as best seen in FIG. 6B, showing an alternate embodiment demonstrating the same principle. In such a configuration, when the straps encircle the athlete's shoulders to securely hold the arm support against the athlete's chest and under the athlete's arms, the arms are positioned in front of and away from the chest, as best seen in FIG. 6A, also showing an alternate embodiment.

Figure 4:
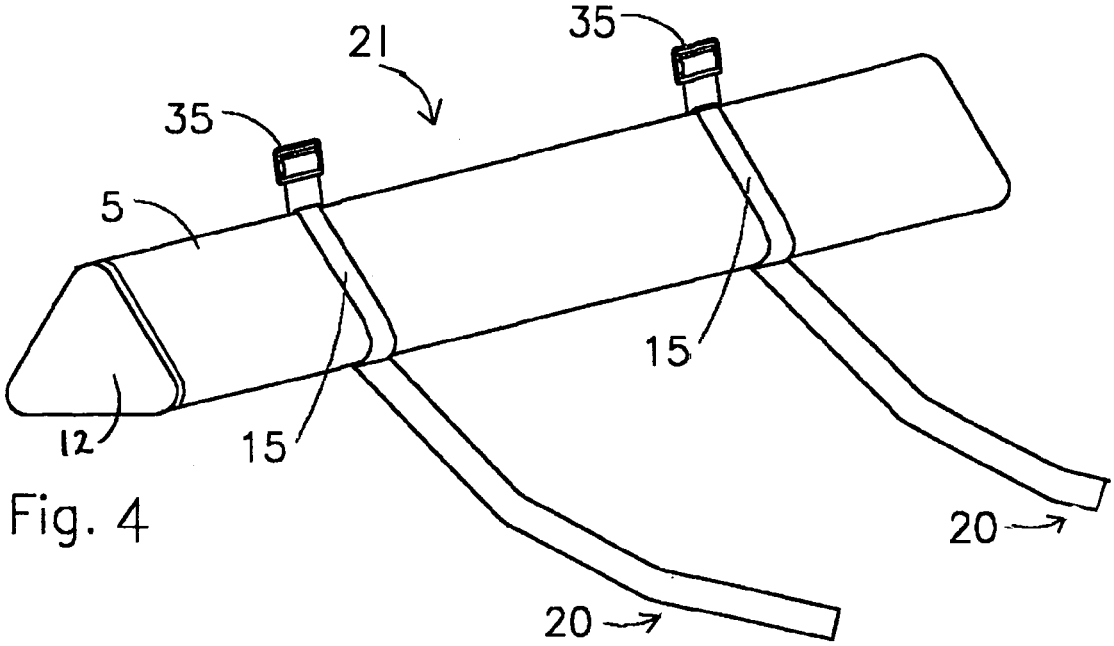
FIG. 4 depicts an oblique view of another embodiment of a sports training apparatus having a removable adjustable strap.
Figure 5:
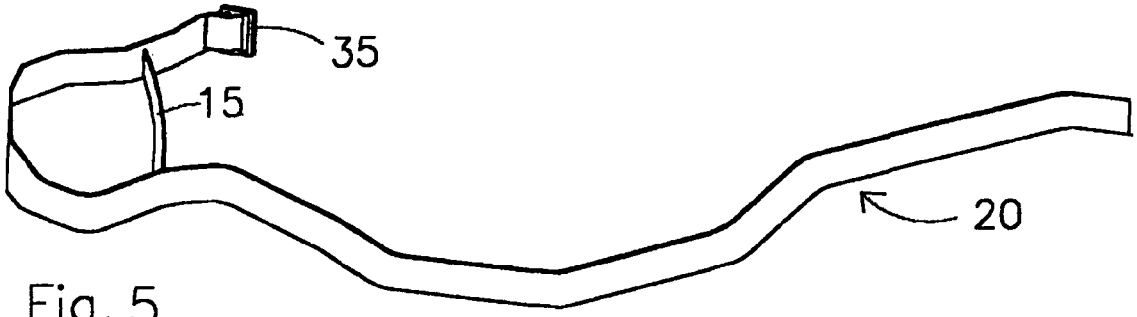
FIG. 5 depicts an embodiment of the removable adjustable strap shown in FIG. 4.
Figure 9:
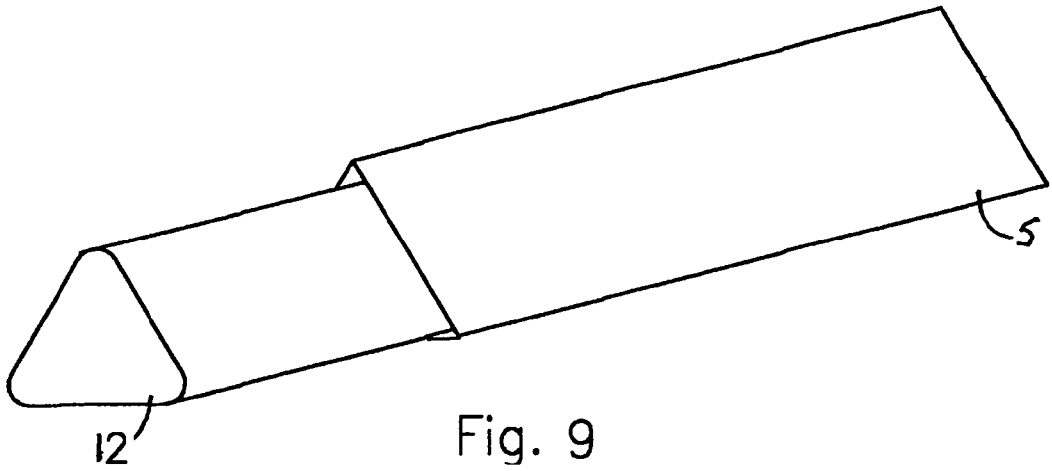
FIG. 9 depicts an oblique view of an embodiment of an arm support partially surrounded by a bag.

FIG. 4 shows a preferred embodiment of a sports training apparatus 21 for correcting the athlete's tendency to allow his arms and elbows to move too close to his torso during general training sessions. In this embodiment, an elongated arm support 12, made of a substantially resilient material, is surrounded by a plurality of removable, adjustable loops of elastic 15 and strap 20. The straps, best seen in FIG. 5, each have a first side and a second side and first end and a second end. The first end of each strap is coupled to a fastening device 35 adapted to couple to the second end of the strap. The fastening device can be a hook and eye device, a buckle mechanism, as shown in FIG. 5, or other suitable devices. An elastic member 15 has a first end coupled to a first side of a strap 20 at a first location and a second end coupled to the first side of the strap at a second location. The elastic member 15 has an unstretched length of a first distance. The first location on the strap is separated from the second location on the strap by a second distance, the second distance longer than the first distance of the elastic member, thus forming a loop of unstretched elastic 15 and strap 20 as shown in FIG. 5. The loops of elastic 15 and strap 20 are adapted to removably surround the elongated arm support 12. The straps are adapted to encircle the athlete's shoulders and adjust until the elongated arm support is held against the athlete's chest in the proper location and under the athlete's arms to position the arms in front of and away from the chest, as best seen in FIGS. 6A and 6B. At the proper adjustment, the fastening device 35 on the first end of each strap 20 is removably coupled to the second end of the strap. In a preferred embodiment, shown in FIG. 4, a lightweight bag 5 removably surrounds the arm support 12 and the loops of elastic 15 and strap 20 are adapted to removably surround bag 5 containing the arm support 12. The bag 5 and arm support 12 assembly is best seen in FIG. 9. The bag 5 can be made of nylon or of other lightweight, sturdy material, and it enhances the ability to use a variety of shapes and compositions of arm support or arm support components. In certain embodiments the bag is made of water resistant material such as GORTEX™.

Figure 10A:
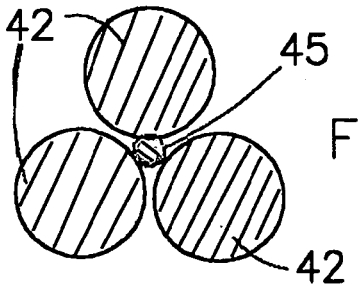
FIG. 10A depicts a lateral cross-section of the embodiment of FIG. 10 shown through section line 10A—10A.
Figure 10:
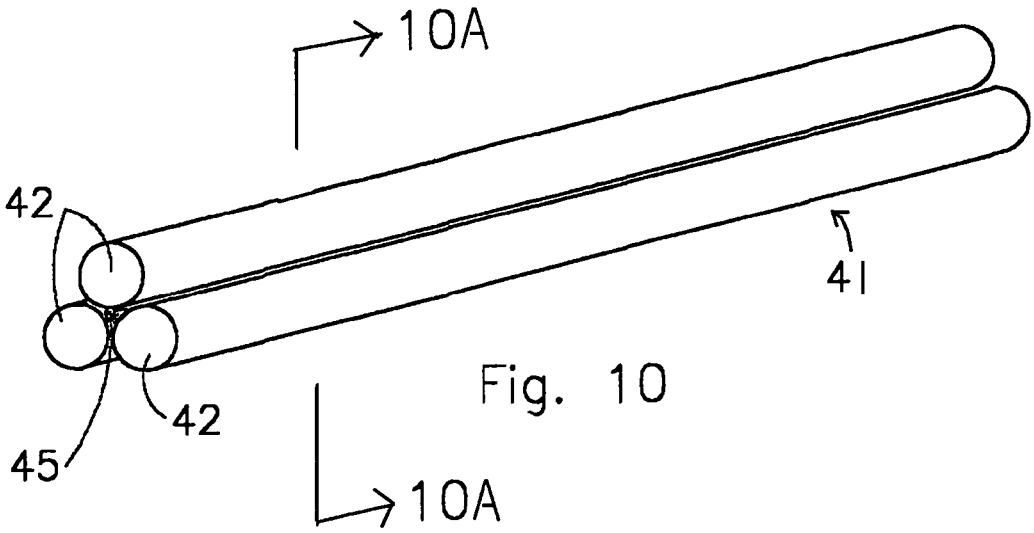
FIG. 10 depicts an oblique view of an embodiment of an arm support having a plurality of resilient support members.

FIG. 10 shows another embodiment of an elongated arm support 41 that includes a plurality of elongated substantially resilient members 42 each of approximately the same length and each having a longitudinal axis. The members 42 are coupled to one another using adhesive or other bonding material in a formation with the longitudinal axes substantially parallel to form a bundle. In certain embodiments, the elongated arm support 41 is removably surrounded by a lightweight bag (not shown) as described above. In other embodiments, best seen along section line 10A—10A in FIG. 10A, the elongated arm support 41 further comprises a substantially rigid member 45 coupled to the resilient members 42 in a parallel fashion and having a length approximately the same as the bundle. The substantially rigid member 45 can be a hard plastic rod or other rigid material. The rigid member 45 allows the use of even softer, more flexible material for the substantially resilient members 42 that surround it.

Figure 7:
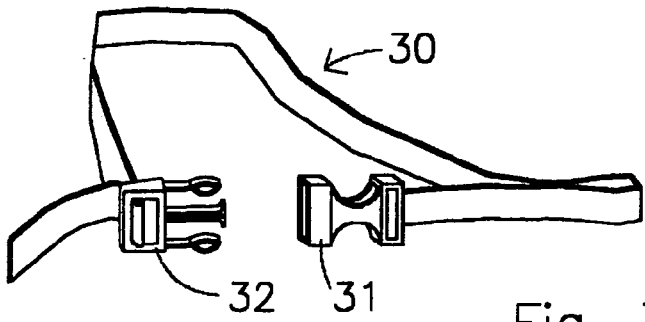
FIG. 7 depicts an oblique view of a connector.
Figure 8A:
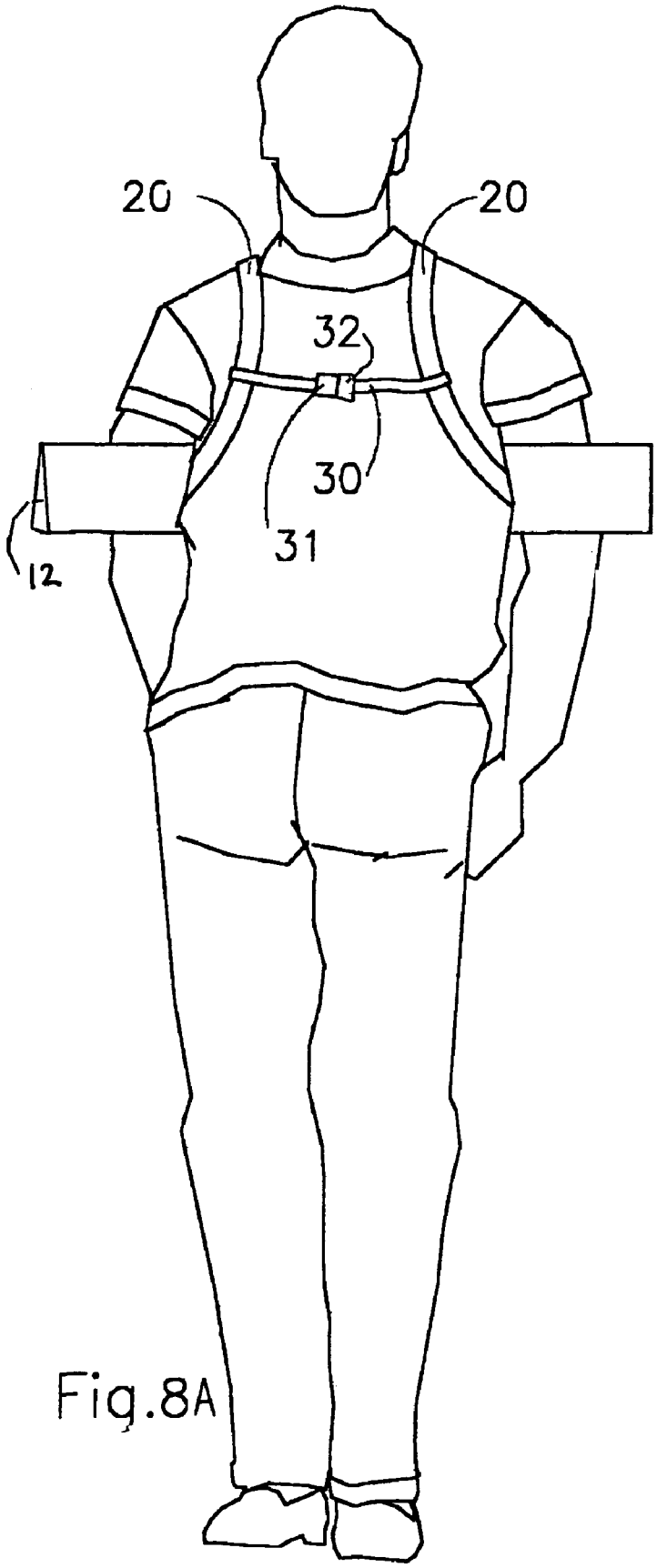
FIG. 8A depicts a rear view of an athlete wearing an embodiment of a sports training apparatus having a connector for support.

Certain embodiments include an elastic connector 30 shown in FIG. 7. The connector 30 has a first end coupled to a fastening device 31 adapted to couple to a second end 32 of the connector. The connector 30 is adapted to surround the plurality of straps 20 and fasten to itself at the athlete's back when the straps encircle the athlete's shoulders, as best seen in FIG. 8A. The elastic connector 30 can be slid or moved up or down the straps to obtain the optimal adjustment. Use of the connector 30 further increases the variety of sizes of athletes that the sports training apparatus will fit.

Figure 8B:
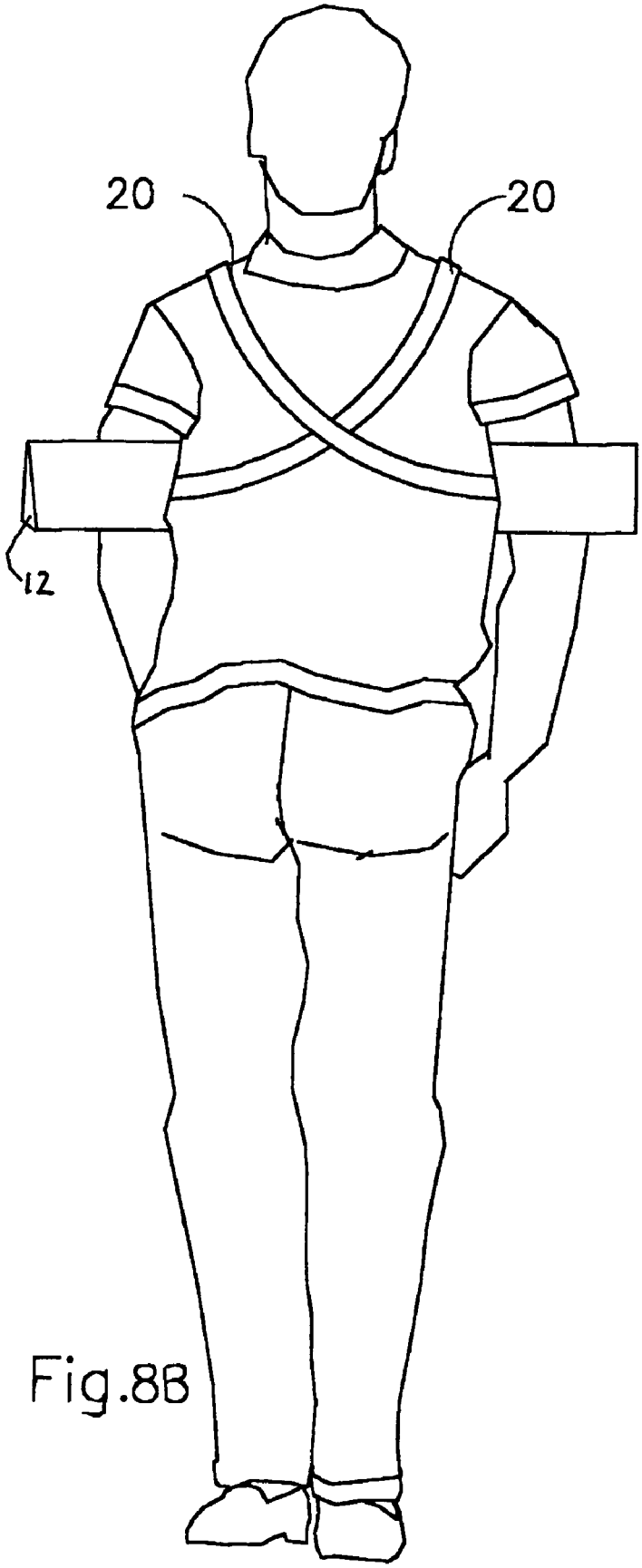
FIG. 8B depicts a rear view of an athlete wearing an embodiment of a sports training apparatus having an alternate means of support.

In another embodiment, shown in FIG. 8B, the straps 20 are crossed over the athlete's back. This configuration also provides support by allowing the second end of a strap 20 to removably couple to the fastening device 35 on another strap 20 (not shown).

Methods for training an athlete include providing an athletic training apparatus having a substantially resilient elongated arm support and a plurality of straps each coupled to the arm support on a first end and removably and adjustably coupled to the arm support on a second end. The elongated arm support 12 is placed against the athlete's chest at a first position proper for a first athletic technique, as best seen in FIG. 6A. The athlete's arms lie over the support 12 at the proper first angle 40 away from the chest. The straps 20 are then brought under the athlete's arms and around the shoulders. The second end of each strap is removably coupled to the arm support, as best seen in FIG. 6B. In the embodiment of FIG. 6B, a fastening device 35 has been used to removably couple the strap to the arm support. The arm support rests snugly against the athlete's chest in the first position. The athlete is then trained on the proper form of the first athletic technique. This athletic technique may include receiving a football, fielding a baseball or other techniques where performance is enhanced by the greater range of motion obtained when an athlete maintains the arms in the frontal plane with elbows away from the body.

Another embodiment of a method of use further includes the steps of removing the second ends of each strap from the arm support and repositioning the elongated arm support against the athlete's chest at a second position proper for a second athletic technique. The athlete's arms lie over the support at the proper second angle away from the chest. The straps are then brought under the athlete's arms and around the shoulders. The second end of each strap is removably coupled to the arm support. Certain embodiments of the method further include the step of training the athlete on the proper form of the second athletic technique.

These methods allow the athlete to be trained in a variety of athletic techniques by adjusting the position of the arm support 12 up, or higher into the arm pit, thus increasing the angle 40 of the arm to the torso, as shown in FIG. 6A, or lowering the position of the support to decrease the angle 40.

While particular devices and methods have been described for using a sports training apparatus, once this description is known, it will be apparent to those of ordinary skill in the art that other embodiments and alternative steps are also possible without departing from the spirit and scope of the invention. Moreover, it will be apparent that certain features of each embodiment as well as features disclosed in each reference incorporated herein, can be used in combination with devices illustrated in other embodiments. Accordingly, the above description should be construed as illustrative, and not in a limiting sense, the scope of the invention being defined by the following claims.

I claim:

1. An apparatus for training an athlete comprising:

An elongated arm support made of a substantially resilient and non-rigid material, such that the arm support is resilient along its length, and wherein the material is capable of reganing its shape after substantially deforming in response to a substantial pressure, the arm support being worn on the athlete's chest with its longitudinal axis horizontal to said athlete's chest, such that the athlete's arms lie over the resilient arm support when at rest; and a plurality of straps, each having a first and second end, the ends coupled to the arm support, securely holding arm support to athlete's chest and under their arms, to form a plurality of strap loops, each loop having a circumference;

wherein the straps loops are adapted to encircle the athlete's shoulders to securely hold the arm support against the athlete's chest and under the athlete's arms to position the arms in front of and away from the chest.

2. The apparatus of claim 1, wherein the substantially resilient material is firm foam rubber.

3. The apparatus of claim 1, wherein the arm support and the second ends of the straps further comprise a removable coupling device, the second ends removably coupled to the arm support.

4. The apparatus of claim 3, wherein the removable coupling device is hook and loop fastening material adapted to adjust the circumference of the loops.

5. The apparatus of claim 3, wherein the fastening device is hook and loop fastening material, and the second end of the strap further comprises the fastening device.

6. The apparatus of claim 3, wherein the fastening device is a buckle mechanism.

7. The apparatus of claim 1, wherein the straps are made of a substantially elastic material.

8. The apparatus of claim 1, wherein the elongated arm support further comprises a plurality of elongated substantially resilient members each of approximately the same length, each having a longitudinal axis, the members coupled to one another in a formation with the longitudinal axes substantially parallel to form a bundle.

9. The apparatus of claim 8, wherein the elongated arm support further comprises a substantially rigid member coupled to the bundles and having a length approximately the same as the bundle and having a length approximately the same as the bundle, the substantially rigid member having a longitudinal axis substantially parallel to the longitudinal axis of the substantially resilient members.

10. The apparatus of claim 1, further comprising an elastic connector having a first end and a second end, the first end connected to a fastening device adapted to couple to the second end, the connector adapted to surround the plurality of straps and fasten to itself at the athlete's back when the straps encircle the athlete's shoulders.

11. The apparatus of claim 1, wherein the elongated arm support is shaped in the form of a wedge.

12. The apparatus of claim 1, wherein the elongated arm support is shaped in the form of a cylinder.

13. The apparatus of claim 1, wherein the straps are made of nylon.

14. The apparatus of claim 1, wherein the arm support comprises a lightweight bag removably surrounding an elongated arm support made of substantially resilient and non-rigid material.

15. The apparatus of claim 14, wherein the bag is made of nylon.

16. An apparatus for training an athlete comprising:

An elongated arm support made of a substantially resilient and non-rigid foam rubber, such that the arm support is resilient along its length;

the arm support being worn on the athlete's chest with its longitudinal axis horizontal to said athlete's chest, such that the athlete's arms lie over the resilient arm support when at rest; and a plurality of straps, each having a first and second end, the ends coupled to the arm support, securely holding arm support to athlete's chest and under their arms, to form a plurality of strap loops, each loop having a circumference;

wherein the straps loops are adapted to encircle the athlete's shoulders to securely hold the arm support against the athlete's chest and under the athlete's arms to position the arms in front of and away from the chest.

17. The apparatus of claim 16, wherein the elongated arm support further comprises a plurality of elongated substantially resilient members each of approximately the same length, each having a longitudinal axis, the members coupled to one another in a formation with the longitudinal axes substantially parallel to form a bundle.

18. The apparatus of claim 17, wherein the elongated arm support further comprises a substantially rigid member coupled to the bundles and having a length approximately the same as the bundle and having a length approximately the same as the bundle, the substantially rigid member having a longitudinal axis substantially parallel to the longitudinal axis of the substantially resilient members.

* * * * *